US005834673A

United States Patent [19]

Gustavsson et al.

[11] Patent Number: 5,834,673

[45] Date of Patent: Nov. 10, 1998

[54] METHOD OF PROVIDING FIXED AMMUNITION WITH AN ADDITIVE WHICH LIMITS BARREL WEAR, AND AMMUNITION PRODUCED IN ACCORDANCE THEREWITH

[75] Inventors: Lennart Gustavsson; Dennis Taylor, both of Karlskoga, Sweden

[73] Assignee: Bofors AB, Karlskoga, Sweden

[21] Appl. No.: 722,101

[22] PCT Filed: Apr. 5, 1995

[86] PCT No.: PCT/SE95/00365

§ 371 Date: Oct. 3, 1996

§ 102(e) Date: Oct. 3, 1996

[87] PCT Pub. No.: WO95/28612

PCT Pub. Date: Oct. 26, 1995

[30] Foreign Application Priority Data

Apr. 19, 1994 [SE] Sweden ..... 9401315

[51] Int. Cl.[6] ..... F42B 33/14; F42B 33/00

[52] U.S. Cl. ..... 86/1.1; 86/19; 102/435; 102/704; 118/55; 118/416; 427/183; 427/189; 427/234

[58] Field of Search ..... 102/430, 435, 102/464, 468, 511, 704; 86/1.1, 17, 19; 427/231, 234, 239, 183, 189, 190; 118/55, 416

[56] References Cited

U.S. PATENT DOCUMENTS

| | | | |
|---|---|---|---|
| 1,780,566 | 11/1930 | Pedersen | 86/19 |
| 2,244,705 | 6/1941 | Hutchinson et al. | 102/511 |
| 2,919,647 | 1/1960 | Dear et al. | 102/464 |
| 3,148,620 | 9/1964 | Jacobson et al. . | |
| 3,204,558 | 9/1965 | Jacobson et al. . | |
| 3,397,636 | 8/1968 | Jacobson et al. . | |
| 3,403,625 | 10/1968 | Jacobson et al. . | |
| 3,403,626 | 10/1968 | Jacobson et al. . | |
| 3,426,684 | 2/1969 | Jacobson et al. . | |
| 3,551,188 | 12/1970 | Lindquist | 427/234 |
| 4,089,998 | 5/1978 | Gibson | 427/234 |
| 4,712,481 | 12/1987 | Heinrich et al. | 102/435 |
| 4,715,285 | 12/1987 | Holler | 102/435 |
| 5,052,304 | 10/1991 | Rahnenführer et al. . | |
| 5,665,444 | 9/1997 | Eguchi et al. | 118/416 |
| 5,686,141 | 11/1997 | Haldenby | 427/234 |

FOREIGN PATENT DOCUMENTS

| | | |
|---|---|---|
| 0235533 | 1/1987 | European Pat. Off. . |
| 2709247 | 10/1984 | Germany . |
| 192 177 | 10/1964 | Sweden . |
| 197 613 | 8/1965 | Sweden . |
| 197 614 | 8/1965 | Sweden . |
| 202 999 | 3/1966 | Sweden . |
| 205 002 | 3/1966 | Sweden . |
| 460 417 | 9/1989 | Sweden . |
| 1599582 | 2/1978 | United Kingdom . |

*Primary Examiner*—Harold J. Tudor
*Attorney, Agent, or Firm*—Law Offices Pollock, Vande Sande & Priddy

[57] ABSTRACT

The present invention relates to a method of applying a wear protection substance to the inside of metal cases used for ammunition. The wear protection substance comprises a composition of wax and a solid particle component which has a known barrel wear reducing effect. The wear protection substance is either applied in molten form to the inside of the metal case or is applied in solid form to the inside of the metal case and then melted. The wear protection substance is then spread to form a layer over the inside of the metal case. The metal case is then cooled whereby a solid coating is formed on the insides of the metal case.

7 Claims, 2 Drawing Sheets

METHOD OF PROVIDING FIXED AMMUNITION WITH AN ADDITIVE WHICH LIMITS BARREL WEAR, AND AMMUNITION PRODUCED IN ACCORDANCE THEREWITH

FIELD OF THE INVENTION

The present invention relates to a method of providing mainly small-caliber, cannon and howitzer fixed ammunition in metal cases with a wear-protection additive for reduction of barrel wear, it being possible for this wear-protection additive to be of a known type. The term small-caliber ammunition in this case means all ammunition for hand-guns and machine guns, i.e., that is to say ammunition with calibers from 4.5 mm to approximately 20 mm.

It is well-known that as wear becomes greater, the "sharper" the powder which is used in the propellent powder charges and, since use is made of particularly sharp propellent powder in ammunition for high-speed projectiles i.e., armor piercing dart projectiles, the invention can be expected to be of special value in this connection. This applies irrespective of whether the propellent powder consists of nitrocellulose powder or so-called "LOVA" powder. As, however, the latter powder type has a certain reputation for producing greater barrel wear than corresponding nitrocellulose powder with approximately the same performance, the invention is particularly applicable in association with ammunition charged with such powder.

LOVA powder means a relatively new type of powder intended, where possible, to constitute a more insensitive replacement for the conventional nitrocellulose powders. The acronym LOVA stands for "low vulnerability ammunition", and in specialist literature a corresponding designation IM standing for "insensitive munition" is sometimes found. LOVA powder includes, among other things, particle crystalline explosive substances.

The main characteristic of these powders is their great pressure sensitivity as far as their burning speed is concerned. In the case of combustion in closed spaces where the pressure increases rapidly by the powder gas pressure generated, for example inside a cartridge case, the combustion of the LOVA powders becomes substantially as the combustion of a conventional nitrocellulose powder; whereas, in the case of combustion in an open space where no pressure increase takes place, the same LOVA powder goes very calmly, perhaps mostly like a stearin candle.

A property of LOVA powders which is of relevance in this connection is that, in addition to the fact that, with the same charging power, they are often somewhat more space-consuming than nitrocellulose powders, and have proved to be more aggressive as far as barrel wear is concerned. It is, therefore, even more important to supplement the LOVA powder charges with wear-protection additives than in the case of previous ammunition charged with nitrocellulose powder. In the case of all high-speed ammunition, for example, such as is charged with armor-piercing darts, and where the propellent powder is made as "sharp" as possible, the same problem is, in principle, present.

Within artillery technology, it has long been known that barrel wear can be reduced most considerably if the combustion of the propellent powder charge takes place in the presence of suitable wear protection. Various metals, metal oxides and salts of metal oxides have been proposed for this purpose. Probably the most common wear-protection substance is $TiO_2$, i.e., titanium dioxide combined with a wax of one type or another. In the wear-protection substance itself, the wax can be included in a quantity corresponding to approximately 50% by weight.

The abovementioned wear-protection substance has, to the extent that it is used, practically always been applied to the charges concerned in the form of a cartridge fabric impregnated with the substance in question. It has also, however, been proposed to manufacture combustible cartridge cases which would in themselves have consisted in part of the wear-protection substance. The latter variant is proposed for example in SE 460.417.

The cartridge fabric impregnated with the wearprotection substance, and sometimes also with a flame damper, has, as a charge additive, often been called "the Swedish additive" among experts, and this product has previously been patented in a large number of countries, although these patents lapsed several years ago. The most important original patents would probably have been SE 197.613, SE 197.614, SE 192.177, SE 202.999, and SE 205.002. A number of different products are proposed in these patents, but it is without doubt that $TiO_2$ had the greatest practical use. It has also been observed for a long time that the wear protection gives the best result if it has, from the outset, been placed close to the barrel wall. It has therefore been common, in the case of fixed ammunition, to lay the impregnated cartridge fabric along the insides of the cases and, in the case of cartridge charges, to lay it immediately inside the outer cartridge fabric.

A disadvantage of providing wear protection in the form of an impregnated cartridge fabric is, however, that the additive takes up a considerable part of the available charging volume. In a certain howitzer charge, a cartridge fabric with the wear protection thus takes up a good 5% of the entire available charging volume. In addition, especially in cases of smaller calibers, and those which are provided with a narrowing case neck, it can often be difficult to make the cartridge fabric lie smoothly against the insides of the cases. This in turn, thus causes the cartridge fabric to take up further space. All the same, it may perhaps be thought to be much too small a volume to constitute a problem, but the fact is that, intensive work is now being carried out to increase the range for older gun systems and at the same time, preparations are being made to go to the insensitive and often more space-consuming so-called LOVA powders. However, it is difficult to accept that an additive of this type, which does not enhance the effect, takes up such a large space. The same problem also applies, of course, to all high-speed projectiles, such as the abovementioned armor-piercing dart projectiles. These act by virtue of their kinetic energy and as a result require the maximum possible exit speed, so that such ammunition must be charged with the sharpest possible powders.

Additional state of the art is constituted by EP A1 0410075 which describes ammunition with combustible case parts of the so-called modular charge type comprising a layer, arranged on the inside, of the abovementioned previously known wear-protection substance consisting of titanium dioxide and wax and in which this wear-protection layer is, in turn, covered by a thin metal foil, made of lead for example. This which prevents direct contact between the propellent powder and the wear-protection layer. According to what is contained in this document, it is considered to be compulsory to prevent the propellent powder from direct contact with the wax/titanium layer since such contact could, at high temperatures, bring about a stabilization of the propellent powder and an associated reduction in its effectiveness. It is proposed therein that this wear-protection layer be applied to the insides of the combustible cases by means of puttying, painting or spraying.

SUMMARY OF THE INVENTION

We have now found that it is possible to provide at least metal cases with corresponding wear layers consisting of the known wax and titanium dioxode wear-protection composition which is so resistant that an anti-stabilization protection in the form of a metal layer never needs to be provided. This is because the wax/titanium dioxide layer produced according to the present invention is so resistant that powder stabilization is never an issue, at the same time that the binding of the layer to the inside of the case is so stable that it requires no further support. One of the reasons why this has become possible is that the method according to the invention permits the utilization of high-melting wax which gives the layer obtained an extremely good strength.

A high-melting wax means, in this case, a wax which has a melting point between approximately 80° and 300° C. Since ammunition is, as a rule, guaranteed to function within the temperature range −40° to +60° C. and the low temperatures do not usually involve any problems as far as wax is concerned, it is a clear advantage, also from other points of view than the risk of the powder being stabilized by the wax, if high-melting wax can be utilized in wear-protection compositions of the type intended here.

The invention also includes two different methods of producing the layer of wear-protection medium and wax, which characterizes the invention, on the insides of the cases. The first method is particularly well adapted for cases of slightly larger calibers such as cannon and howitzer cases, while the second method is more suitable for small-caliber cases. It would also be possible to provide the latter type with a suitable internal wear-protection coating by immersion, but then an outer coating would also be obtained which has to be removed from the finished charged cartridge since such an outer coating can otherwise interfere with the functioning in automatic weapons. The second method, however, probably requires a relatively high degree of automation in order to become economically sound.

The invention is thus especially advantageous in that the smallest possible part of the available case volume is blocked, and at the same time the functioning of the charge is not in the least affected. Charging volume thus freed therefore becomes available for an increase in the quantity of propellent powder. A further advantage of the invention is that it does not presuppose any extra additives to the wear-protection composition, for example in the form of solvents, and at the same time it is easy to utilize.

The basic principle of the invention therefore means that the respective cartridge cases are coated on the inside with a preferably uniformly thick and homogeneous layer consisting of a wear-protection substance in the form of mixtures of a high-melting wax and a fine-particle metal, metal oxide or other known substance or proposed in the future as wear-protection medium for this specific purpose. In the case of the first method indicated above and characteristic of the invention, which is suited for coating slightly larger cases, the complete wear-protection composition is applied to the interior of the cases in the form of solid pieces or tablets which are adapted to the size and shape of the cases. These distributed along the interior of the case at a tested distance from one another, after which the wax in the composition in question is gradually melted in the heated case which is rotated about its essentially horizontally arranged axis at a speed selected with regard to the desired coating. During this treatment, the solid pieces or tablets therefore follow a helical path along the inside of the case and, since they are simultaneously melted, they leave behind them a gradually growing cohesive layer of the wear-protection substance on the inside of the case. When this has obtained a desired spread and thickness, the case is cooled. A wear-protection composition which can be used specifically for this method has proved to be that which also includes, in addition to a suitable high-melting wax, the previously mentioned fine-particle titanium dioxide. Together with the wear-protection medium in particle form, a decopper-plating medium of a likewise known type can also be included together with the wax.

Various types of wax have for a long time been used in connection with powder, and thus, a wealth of experience has been gathered on which wax can be used together with powder. This and this is of great importance since, within this field, there has always been great reluctance, perhaps in view of the long-term storage problems, to introduce new untested products in powder and explosives. It is therefore mainly a matter of selecting a suitable high-melting wax which gives a wax wear-protection layer with the desired strength properties.

In reality, the designated wax is linked more to the physical properties of these products than to their chemical structure. Within the general designation a wax, two different main groups are usually considered. One of these main groups includes chiefly esters with the general formula RCOOR' where R and R' are an acid and alcohol group, respectively, with as a rule 16–30 carbon atoms. However, alcohols in the form of so-called sterols can also be included in this main group. An example of the latter type which has previously proved of interest in connection with powder and explosives is oxazoline wax which is manufactured synthetically from nitroparaf fins and contains the so-called oxazoline group. The second main wax group consists of paraffin wax with crystalline structure. These are obtained from certain petroleum crude oils and clay slate oils. The molecular form of these waxes is $C_{20}H_{42}$ and above. From a chemical point of view, waxes are, in fact, generally rather inert.

To further clarify what is meant here by the designated wax, refer to the book "Industrial Waxes" Volume I by H. Bennet, Chemical Publishing Company New York 1975.

The wax utilized according to the invention is required to have an adequately good adhesion against the inside of the case and to have an adequately high melting point so that at high temperatures there are no problems with stabilization of the powder charged in the cases.

In practical tests with ammunition for a 40 mm automatic cannon in which the wear-protection composition was applied to the heated case in the form of pieces or tablets of 1–3 grammes, it has emerged that a coating according to the invention corresponding to 0.5–1.0% of the charge weight gives acceptable wear protection. This relatively small quantity is to be compared with the 5% mentioned previously in the text with reference to a wear protection of the older model comprising a space-consuming cartridge fabric and wear-protection substance. As far as comparisons with the wear protection having protective metal foil described in EP 0410075 are concerned, the difference is of course considerably smaller as far as the space gain is concerned, but then there is instead the advantage that the actual protection layer does not have, to be applied. We have moreover, been unable to find any more detailed description of how this is brought about in the above patent specification.

In order for the wear-protection composition to be able, in an effective manner, to go with the hot powder gases out into the barrel, it should preferably be applied to the inside of the case in its front third directly behind the fixed projectile. With this positioning, the wear protection is exposed to the maximum possible overflow of hot powder gases, and the maximum possible utilization of its positive properties is thus guaranteed. In the case of the first method of the invention, the desired positioning of the wear-protection layer is selected by fixing or varying, during rotation of the case, the inclination of the case relative to the horizontal plane and by selecting the distance between the starting positions of the tablets.

In the case of the second method is of the invention and is suitable mainly for small-caliber cases, the wear-protection composition is applied with the wax in the molten phase to the interior of the heated case, which is rotated at a suitable speed, through a thin, heated pipe which is introduced through the case neck and opens directly adjacent to the case wall and, on rotation of the case, spreads the wear-protection composition out into a uniform layer with the desired spread. The spread of the wear-protection layer can be controlled by means of a relative displacement between the application pipe and the case.

Of the components included in the wear-protection composition according to the invention, titanium dioxide has the effect that it reduces the heat radiation of the powder gases to the barrel wall by shielding the same and by dilution, at the same time as it forms a foundation for a dispersion of particles which is distributed over the barrel surface. Moreover, the titanium dioxide catalyzes the reduction of oxidizing combustion products so that these are not able to attack the barrel wall.

Turning to the wax component of the wear-protection composition, this contributes to a reduction of the flame temperature through an energy-requiring decomposition, and at the same time it forms a "swollen" layer of gasified and partly decomposed material distributed along the barrel wall and produces a coating of the barrel wall with an insulating layer of residues from wear protection which prevents heat transmission and chemical influence from the powder gases.

Although the effect of the wear protection obtained according to the invention corresponds, in principle, to the effect of previously used cartridge fabric-borne wear protection, the present method of producing wear protection is completely different. At the same time, the product obtained is different and, moreover important, charging space is gained. At the same time it also becomes possible to utilize a more energy-rich powder which in both cases can be utilized in order to improve the performance of the artillery pieces in question.

The invention has been defined in the following patent claims and it is now to be illustrated somewhat further by examples below, at the same time as reference is made to the attached figures for further details.

To test the invention, 200 cases of 40 mm ammunition intended for Bofors L/70 automatic cannon were coated on the insides along the front third of the cases with a layer of wax plus titanium dioxide. The coating was made in the manner indicated above by three pellets per case of around 3 grammes each of a ready-mixed wax/titanium dioxide mixture (50:50) being melted in the cases which have been heated to a suitable temperature while being rotated about with an essentially horizontal axis. In the coated parts of the cases, the coating was given a thickness of approximately 1 mm which in this case corresponded to less than 1% of the available charging space. The cases were charged with a high-energy nitrocellulose powder and an armor-piercing dart projectile. The test firing of this ammunition showed that the barrel wear was approximately 1/10 of the corresponding wear for the same ammunition but without wear protection.

DETAILED DESCRIPTION OF THE PREFERRED EMBODIMENTS

Figure 1:
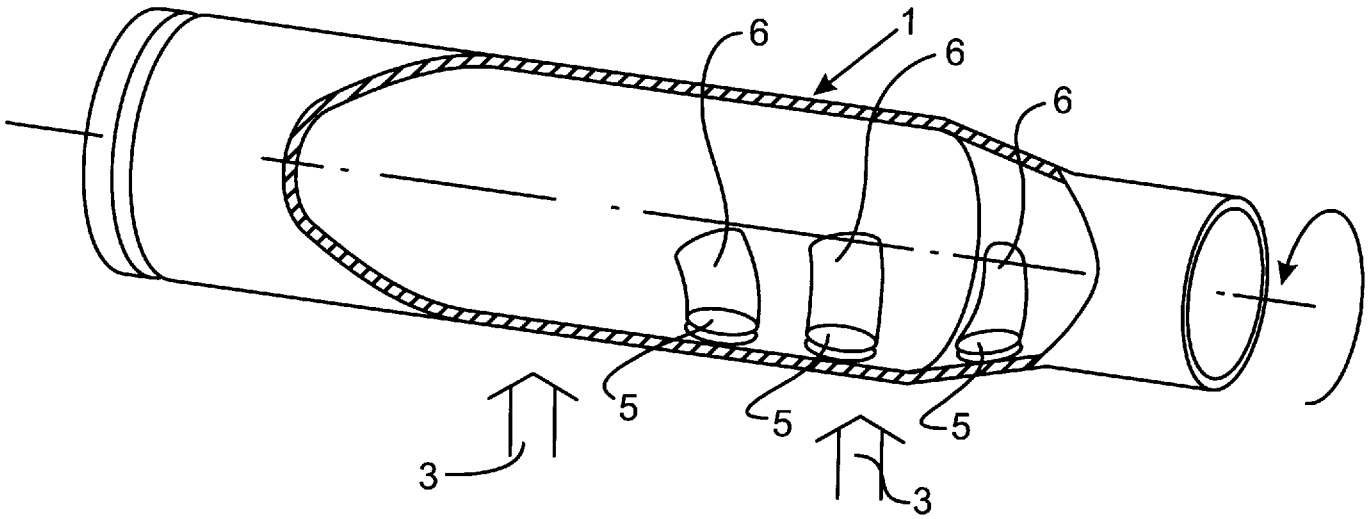
FIG. 1 shows a partly cut-away 40 mm artillery case during application of wear-protection medium according to method one, of the invention, and, FIG. 2 shows a partly cut-away small-caliber case during application of wear-protection medium according to method two of the invention.

The case 1 shown in FIG. 1 is rotated about its longitudinal axis 2 and is heated, for example, by means of radiation heat or induction marked 3. Three tablets 5 of solid wear-protection composition have been placed relatively close to the case neck 4. When the case 1 is rotated with simultaneous heating, the wear-protection composition in the tablets 5 is gradually spread out on the inside 5 of the case and when the layer 6 thus obtained has reached a desired thickness and spread, the case is cooled.

Figure 2:
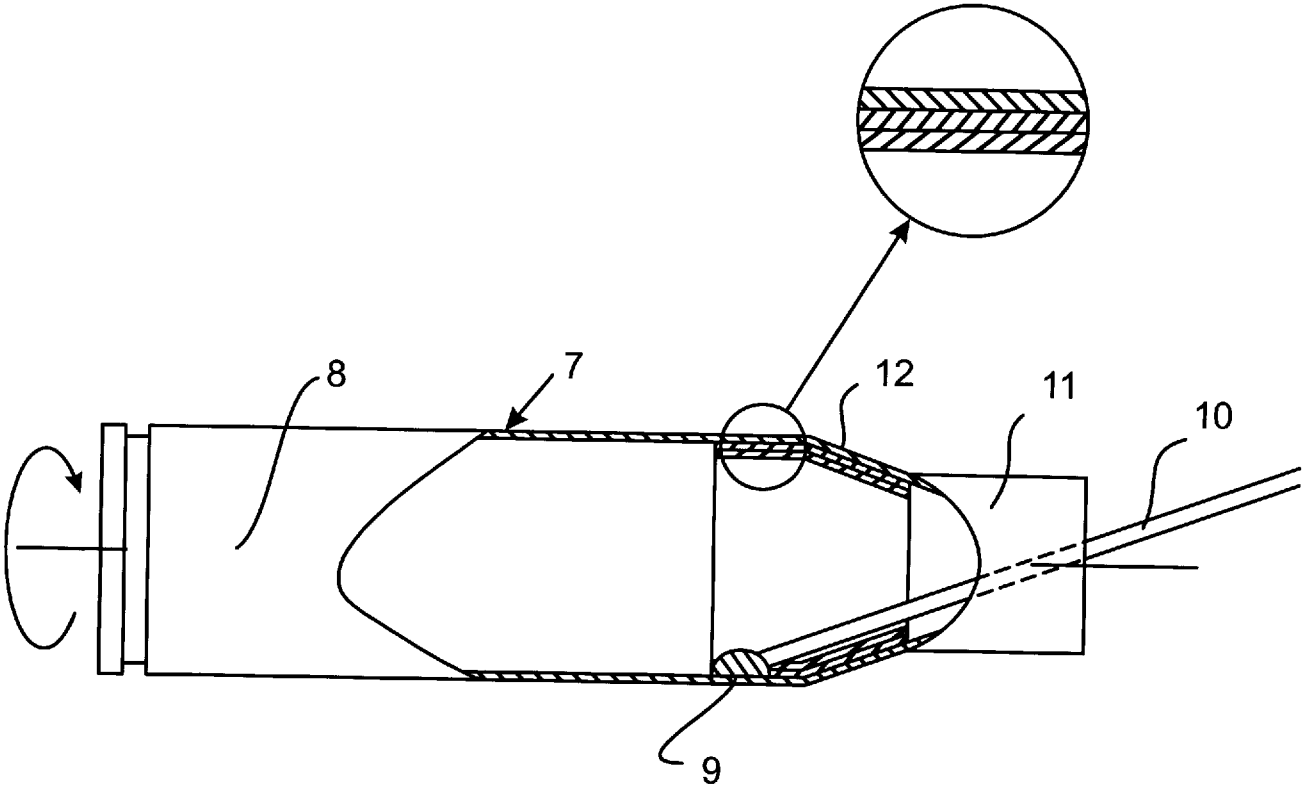

It is a prerequisite for the case 7 shown in FIG. 2 also to be heated, the heat supply having been indicated at 3 and the case being rotated about its longitudinal axis 8, but here the wear-protection composition 9 is applied with the wax in molten phase through a heated pipe 10 which is narrow in relation to the case neck 11 and which has been introduced through the case neck and opens directly above the inner wall of the case and therefore functions as both application member and distribution member in that it spreads the wear-protection composition applied into a thin layer 12. Layer 12 may comprise several layers of the wear protection composition spread on top of each other as shown on the top side of FIG. 2. The spread of layer 12 in the longitudinal direction of the case can be adjusted by a mutual longitudinal displacement between the case 7 and the pipe 10.

We claim:

1. A method of reducing barrel wear on firing fixed ammunition having a metal case, including the steps of:

heating said case;

applying to the insides of the cases, before charging thereof, a molten substance comprising a wax, having bound therein a solid material in particle form with known barrel-wear-reducing effect, via a narrow heated pipe introduced through a case neck;

utilizing an outlet end of said pipe for distribution of said molten substance over the inside of said case;

forming said substance into a coherent layer on the inside of said case; and cooling said layer to solidification.

2. A method according to claim 1, wherein a longitudinal axis of the case is, inclined relative to a horizontal plane whereby the obtained layer of wax and solid material is substantially limited to the front third of the case.

3. A method according to claim 1 further comprising the step of rotating said case about its longitudinal axis until said coherent layer of desired thickness and spread has been achieved.

4. A method according to claim 1 further comprising the step of displacing said pipe and said case in relation to one another.

5. A method of providing a metal cartridge case of fixed ammunition with an inner barrel wear reducing layer, said layer comprising a composition of wax and a solid component in particle form which has a known barrel-wear-reducing effect, comprising the steps of:

applying said composition to the inside of a case in the form of solid pieces or tablets;

heating said case to gradually melt said wax included in said composition against the inside of the case, thereby forming a layer of wax and said solid component on the inside of the case, wherein the case is rotated about its essentially horizontal longitudinal axis until a layer of desired thickness and spread has been obtained; and cooling the case so that the composition is transformed completely to a solid form.

6. A method according to claim 5, wherein said desired layer thickness is obtained by providing a number of layers successively laid on each other.

7. A method according to claim 5 wherein a longitudinal axis of the case is inclined relative to a horizontal plane whereby the obtained layer of wax and solid material is substantially limited to the front third of the case.

* * * * *

UNITED STATES PATENT AND TRADEMARK OFFICE

CERTIFICATE OF CORRECTION

PATENT NO. : 5,834,673
DATED : November 10, 1998
INVENTOR(S) : Gustavsson et al.

It is certified that error appears in the above-identified patent and that said Letters Patent is hereby corrected as shown below:

On the title page, item [73] Assignee, should read--
Bofors AB, Karlskoga, Sweden and
Celsius Materialteknik Karlskoga AB, Karlskoga, Sweden

--.

Signed and Sealed this

Tenth Day of August, 1999

*Attest:*

*Attesting Officer*

Q. TODD DICKINSON

*Acting Commissioner of Patents and Trademarks*